US009817430B2

(12) United States Patent
Messadek

(10) Patent No.: US 9,817,430 B2
(45) Date of Patent: Nov. 14, 2017

(54) PROTECTIVE APPARATUSES FOR ROTARY CONTROL KNOBS

(71) Applicant: Karim Messadek, Paris (FR)

(72) Inventor: Karim Messadek, Paris (FR)

(73) Assignee: Karim Messadek, Paris (FR)

( * ) Notice: Subject to any disclaimer, the term of this patent is extended or adjusted under 35 U.S.C. 154(b) by 138 days.

(21) Appl. No.: 14/827,759

(22) Filed: Aug. 17, 2015

(65) Prior Publication Data

US 2015/0346759 A1 Dec. 3, 2015

Related U.S. Application Data

(63) Continuation-in-part of application No. 14/181,687, filed on Feb. 16, 2014, now abandoned.
(Continued)

(51) Int. Cl.

| | |
|---|---|
| ***G05G 5/00*** | (2006.01) |
| ***G10H 1/32*** | (2006.01) |
| *G05G 1/08* | (2006.01) |

(52) U.S. Cl.
CPC ..... *G05G 5/005* (2013.01); *G10H 1/32* (2013.01); *G05G 1/08* (2013.01);
(Continued)

(58) Field of Classification Search
CPC ..... G05G 1/08; G05G 1/082; G05G 1/087; G05G 1/10; G05G 5/005; G05G 5/528; G10H 1/32
See application file for complete search history.

(56) References Cited

U.S. PATENT DOCUMENTS

| | | |
|---|---|---|
| 340,467 A | 4/1886 | Villerot |
| 1,509,676 A | 9/1924 | Lawrence |

(Continued)

FOREIGN PATENT DOCUMENTS

| | | |
|---|---|---|
| EP | 2110730 A1 | 10/2009 |
| FR | 2689256 A1 | 10/1993 |

OTHER PUBLICATIONS

Ab.com. Online.Rockwell Automation, Inc., Online on or before Jan. 17, 2014. Retrieved from the Internet: Oct. 29, 2015 <URL: http://www.ab.com/en/epub/catalogs/12768/229240/229244/2531083/Accessories.html>.

(Continued)

*Primary Examiner* — Christopher M Koehler
(74) *Attorney, Agent, or Firm* — Patentfile, LLC; Bradley C. Fach; Steven R. Kick

(57) ABSTRACT

In some embodiments, a protective apparatus for rotary control knobs may comprise a cover adapted fit over a rotary control knob; a knob cavity internal to the cover adapted to provide space for the rotary control knob to rotate about; and an access aperture located on the surface of cover member and adapted to provide limited user access to the rotary control knob. The cover member may be configured to encase or surround a control knob. The apparatus may further comprise a plate which may be integrally formed or molded to the cover and which contains a control shaft aperture adapted to receive the control shaft of a rotary control assembly. Once a control shaft is inserted through the control shaft aperture, a fastener may be secured to the control shaft over the plate, thereby securing the apparatus to the control shaft.

9 Claims, 14 Drawing Sheets

Related U.S. Application Data

(60) Provisional application No. 61/767,887, filed on Feb. 22, 2013.

(52) U.S. Cl.
CPC .... *Y10T 29/49716* (2015.01); *Y10T 29/49718* (2015.01); *Y10T 74/20876* (2015.01); *Y10T 428/13* (2015.01)

(56) References Cited

U.S. PATENT DOCUMENTS

| | | | | |
|---|---|---|---|---|
| 2,787,746 | A * | 4/1957 | Redmond | B64C 13/04 244/236 |
| 4,154,125 | A | 5/1979 | Frank | |
| 4,347,758 | A | 9/1982 | Geil et al. | |
| 4,373,405 | A | 2/1983 | Geil | |
| 4,624,178 | A | 11/1986 | Keating | |
| 5,083,477 | A | 1/1992 | Geil | |
| 5,711,415 | A * | 1/1998 | Fukuda | G01D 5/25 200/4 |
| 5,981,862 | A | 11/1999 | Geier, Jr. | |
| 6,404,187 | B1 * | 6/2002 | Ruckert | F16H 59/0217 324/207.2 |
| 6,621,016 | B2 | 9/2003 | Ohba et al. | |
| 7,479,607 | B2 | 1/2009 | Sack et al. | |
| 2006/0070482 | A1 * | 4/2006 | Steele | F16H 59/0278 74/523 |
| 2008/0068934 | A1 * | 3/2008 | Hiranuma | G04B 3/043 368/288 |
| 2015/0317966 | A1 * | 11/2015 | Liptac | G10H 1/32 84/735 |

OTHER PUBLICATIONS

Fullcompass.com. Online.Lectrosonics 26011-1 Knob Guard for R1A FullCompass LTD. Online on or Before Jan. 17, 2014. <URL: http://www.fullcompass.com/prod/248462-Lectrosonics-26011-1/ >.

Meyette.us. Online.Brian Meyette Engine Work Online on or before Feb. 2009. Retrieved from the Internet Oct. 29, 2015. <URL: http://www.meyette.us/engineFeb09.htm>.

* cited by examiner

PROTECTIVE APPARATUSES FOR ROTARY CONTROL KNOBS

CROSS REFERENCE TO RELATED APPLICATIONS

This application is a continuation-in-part of U.S. Non-Provisional application Ser. No. 14/181,687, filed on Feb. 16, 2014, entitled "protective Apparatuses FOR ROTARY CONTROL KNOBS", which claims the benefit of U.S. Provisional Patent Application Ser. No. 61/767,887, filed on Feb. 22, 2013, entitled "SAFETY DEVICE FOR ROTARY CONTROL KNOBS", the entire disclosures of which are incorporated by reference herein.

FIELD OF THE INVENTION

The present invention relates to the field of rotary knob protective and enhancing apparatuses. More specifically, the invention relates to apparatuses configured to limit rotational access to a knob.

BACKGROUND

Foot operated effects pedals (sometimes referred to as "stomp boxes") are frequently used by guitarists and other musicians to modulate or alter the sound of a musical instrument. They typically consist of an electronic circuit housed inside a relatively small enclosure, and a plurality of control knobs, foot-switches, toggle-switches, connectors, and the like.

The electronic circuit processes the incoming instrument signal before outputting it to an amplification system. Control knobs allow the user to adjust various key parameters of the electronic circuit. Foot-switches allow the musician to conveniently actuate the effect on and off using his foot.

The fast growing effects pedals market has provided musicians with hundreds, if not thousands of pedals of various types and sizes to choose from. New standards of pedal layout and quality have also been established by increasing numbers of boutique pedal manufacturers, making available to a greater number of musicians effects pedals that were only meant to be used by professionals in the past.

Musicians, especially guitarists, have learned to use and combine multiple effects pedals in order to create various sound effects which are typically described as various textures, colors, and shades of sounds. While being time consuming due to the almost endless pedal combinations and possibilities, finding the right combination is very rewarding and desirable for the tone-conscious musician.

The trend of using multiple effects pedals has, in turn, led manufacturers towards designing smaller, more compact pedals, so that a large number of them can be arranged onto reasonable sized pedal-boards. Pedal-boards are essentially platforms on which a plurality of effects pedals, audio interfaces, and power supplies are attached and arranged on.

The typical distance between the on/off foot-switch and the closest control knob, on today's effects pedals, can vary anywhere between 0.75 inches to 1.5 inches at most. Stepping on the on/off foot-switch without inadvertently disturbing or stepping on the control knobs can therefore be a challenging task. This challenge is even greater if the pedal sits in between other pedals on a tightly packed pedal-board. There is always a risk of accidentally disturbing the adjacent control knob's setting, and this scenario is simply not acceptable in the middle of a stage performance.

Control knobs settings can also be disturbed when musicians transport their effects pedals or pedal-boards inside light-weight soft bag (sometimes referred to as "gig bags"). The friction between the inner surfaces of the bag and the pedals often causes the control knobs to inadvertently move during transport, forcing the musicians to constantly reset the knobs positions before using the pedals.

Several related art arrangements are known to provide locking devices to securely hold a control knob setting. Devices shown in U.S. Pat. No. 4,154,125 and U.S. Pat. No. 4,347,758 work essentially by applying to the control knob or to the control shaft a sufficient drag force so to resist knob rotation from some external perturbations, like vibrations, or other small forces. However, an 'on the fly' operation of the control knob is impossible, since it requires the user to first unlock the locking device, set the knob position, and then re-lock the locking device. Performing musicians need to quickly change their knobs settings on one or more pedals in between songs during a set. They typically have a handful of seconds to tweak several knobs, which is impractical with these locking systems in place. Additionally, these locking devices do not provide any protection to the control knobs themselves and thus the knobs may fall off or otherwise become inadvertently damaged.

Unfortunately, many touring musicians tend to use duct tape and the like to secure their control knob settings. The tape is generally applied in a way that completely covers the control knob and part of the surrounding pedal surface, thus preventing the knob from moving. In this set-and-forget approach, neither a visual inspection, nor an 'on the fly' adjustment of the knob setting is possible.

The Company Hardwire™ has developed a proprietary device known as Stomplock™. It is essentially a molded rubber cover that achieves the same function as the duct tape method but in a more elaborate way. However, Stomplock™ cannot be applied to individual knobs and is suffers from the same set-and-forget solution drawbacks mentioned above.

Therefore, a need exists for novel protective apparatuses for rotary control knobs which effectively precludes any inadvertent or accidental disturbance of control knobs settings when actuating or transporting effects pedals. There is a further need for an apparatus that enables the user to quickly adjust, on the fly, the control knob settings with the protective apparatus in place. There also exists a need for an apparatus that provides the ability to perform, without physically interacting with the apparatus, visual monitoring and inspection of the knob settings. Finally, there exists a need for an apparatus which allows the ability to provide an easy retrofit protective solution to the knobs of any effects pedal without modification to the pedal or its components.

BRIEF SUMMARY OF THE INVENTION

Protective apparatuses for rotary control knobs are provided which are configured to limit unintentional manipulation of a control actuator, such as a rotary knob, on an electronic device. In some embodiments, a protective apparatus for rotary control knobs may comprise a cover adapted fit over a rotary control knob; a knob cavity internal to the cover adapted to provide space for the rotary control knob to rotate about; and an access aperture located on the surface of cover member and adapted to provide limited user access to the rotary control knob. The cover member may be configured to encase or surround a control knob.

In further embodiments, the apparatus may further comprise a plate which may be integrally formed or molded to the cover and which contains a control shaft aperture adapted to receive the control shaft of a rotary control assembly. Once a control shaft is inserted through the control shaft aperture, a fastener may be secured to the control shaft over the plate, thereby securing the apparatus to the control shaft.

In still further embodiments, the apparatus may be configured to rotate about a central axis to change the orientation of the lateral access apertures by rotating the apparatus about a control shaft which is inserted through the control shaft aperture.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New protective apparatuses for rotary control knobs are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 1:
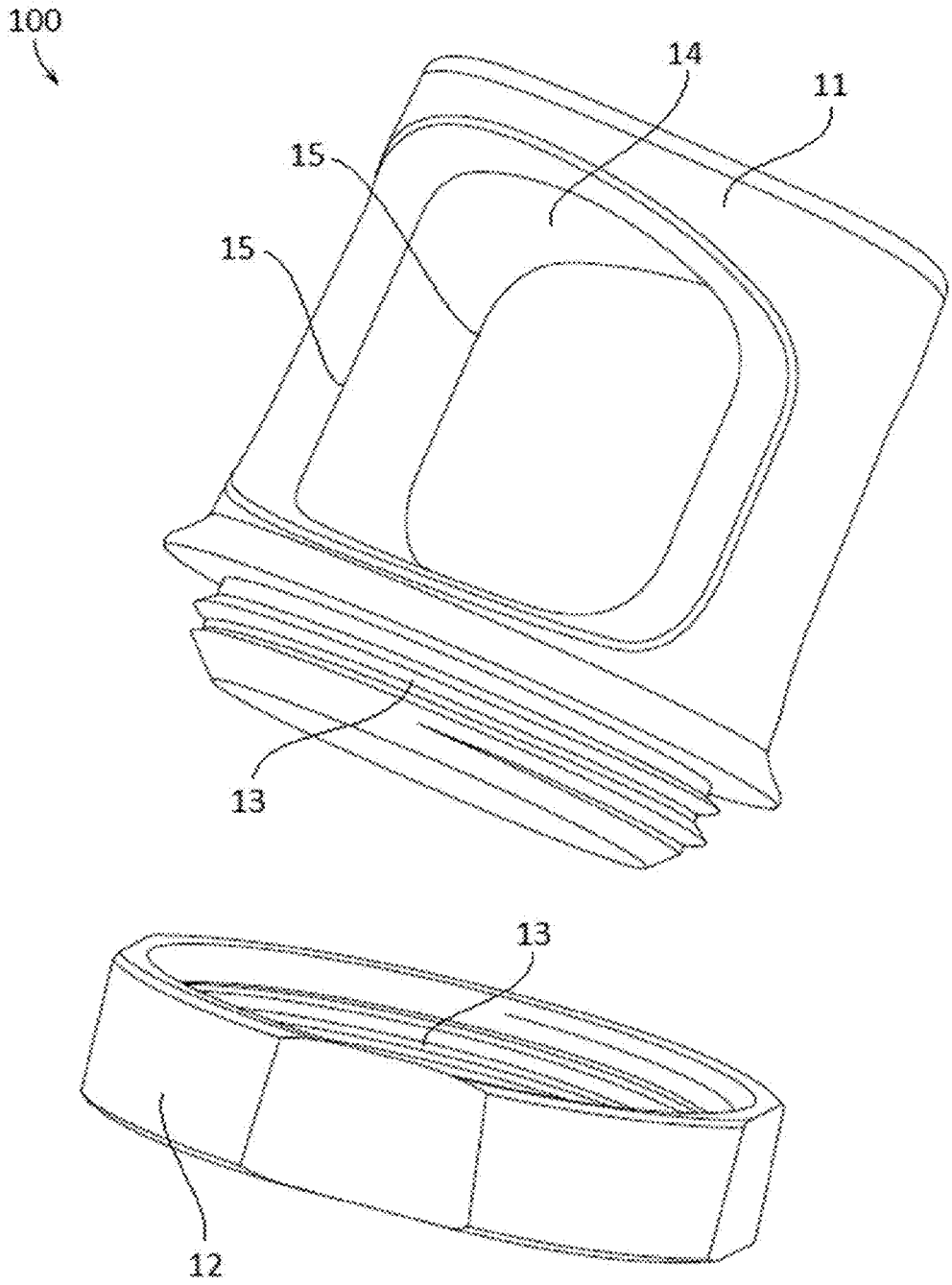
FIG. 1 depicts a side perspective view of an example of a protective apparatus for rotary control knobs according to various embodiments described herein.

The present invention will now be described by example and through referencing the appended figures representing preferred and alternative embodiments. FIG. 1 illustrates an example of a protective apparatus for rotary control knobs ("the apparatus") 100 according to various embodiments of the present invention. In this example, the apparatus 100 comprises a cover member 11, a plate member 12, and a coupling device 13 which is positioned on both the cover member 11 and the plate member 12.

The cover member 11 is preferably fashioned in a cylindrical-like shape, comprising a knob cavity 14 configured to be larger than and to encase a desired rotary control knob, but other shapes can be envisioned. Also depicted in this embodiment are two access apertures 15 which are configured to allow access to the knob cavity 14 enabling a user to manipulate an encased control knob 213 (FIGS. 5-8, and 16). The cover member 11 functions as a protective guard to limit unintentional manipulation of an encased control knob caused by accidentally bumping or impacting the knob. In some embodiments, setting marks can be machined on, or affixed to the cover member 11 to indicate to the user the degree of rotation of a knob 213.

A coupling mechanism 13 may be positioned along the lower circumference of the cover member 11 and is configured to engage and secure to a complementary coupling mechanism 13 positioned on the plate member 12. The function of the coupling device 13 is to create a removable connection where the cover member 11 and the plate member 12, may be completely separated at one time, and at another time be joined together so they act as a continuous part. In some embodiments, the coupling device 13 may be fashioned in the form of a threaded screw type connection method, a push-to-lock type connection method, a turn-to-lock type connection method, or any other suitable temporary connection method as one reasonably skilled in the art could envision to serve the same function.

Figure 2:
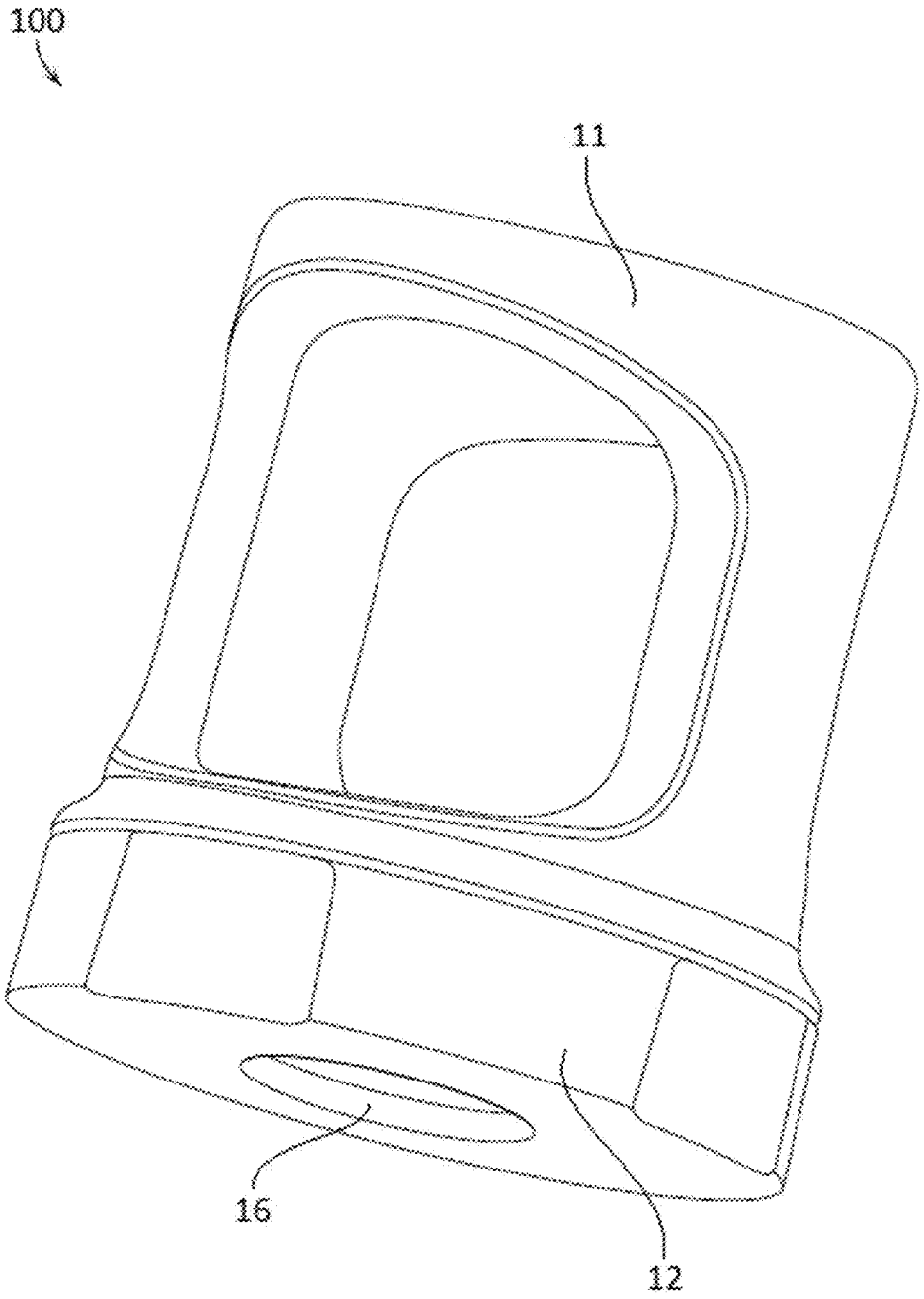
FIG. 2 illustrates a side perspective view of an example of a protective apparatus for rotary control knobs according to various embodiments described herein.

FIG. 2 illustrates a side perspective view of an example of an apparatus 100 according to various embodiments of the present invention. In this embodiment, the apparatus 100 comprises a cover member 11 that is securely engaged to a plate member 12 which comprises a control shaft aperture 16. In some alternative embodiments, the cover member 11 may be permanently engaged to the plate member 12 with glue, epoxy, chemical bonding, heat bonding, or other suitable permanent joining technique. In other alternative embodiments, the cover member 11 may be integrally formed to the plate member 12.

Figure 3A:
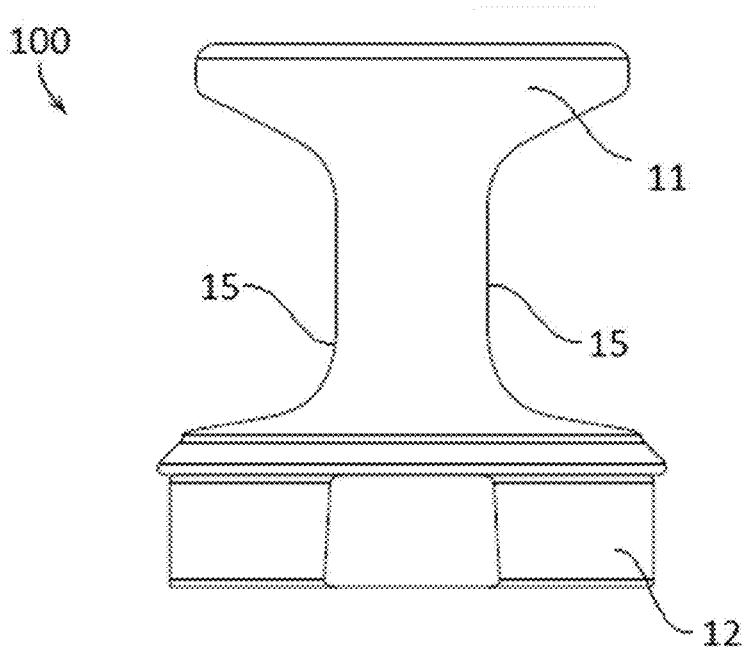
FIG. 3A shows a first side elevation view of an example of a protective apparatus for rotary control knobs according to various embodiments described herein.
Figure 3B:
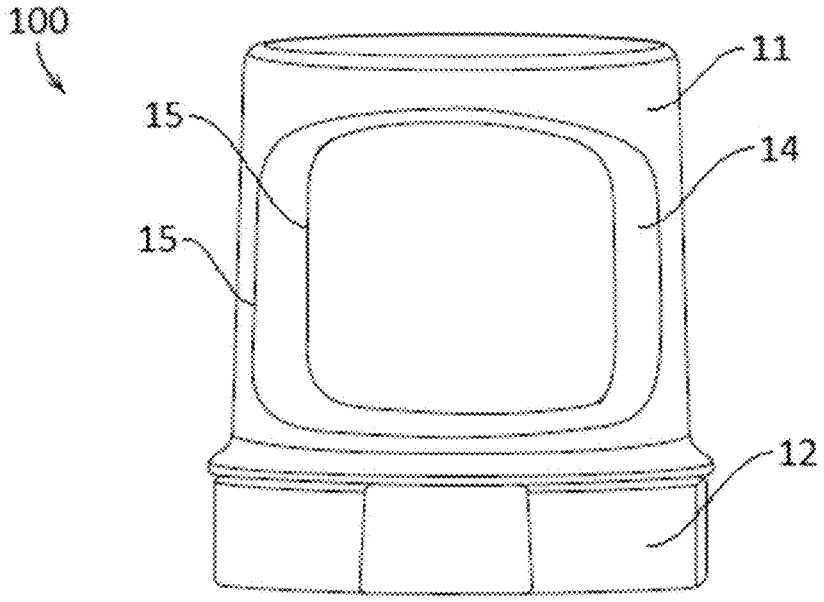
FIG. 3B shows a second side elevation view of an example of a protective apparatus for rotary control knobs according to various embodiments described herein.

Turning now to FIGS. 3A and 3B, which shows side perspective views of an example of an apparatus 100 according to various embodiments of the present invention. In FIG. 3A, the plate member 12 is engaged to the cover member 11 which comprises two oppositely positioned access apertures 15 which are configured to allow a user to access the knob cavity 14 (FIGS. 1 and 3B) with one or more fingers or any other suitable tool such as a guitar pick. As depicted in FIG. 3B, the apparatus 100 of FIG. 3A has been rotated approximately 90 degrees along a central axis so that the two access apertures 15 are viewed in-line with each other. Access apertures 15 may be substantially rectangular in shape, circular in shape, or comprise any other suitable geometric shape. In some embodiments, the apparatus 100 may contain one, two, three, four, five, or even six access apertures 15 providing access to the control knob 213 (FIG. 5).

Figure 4A:
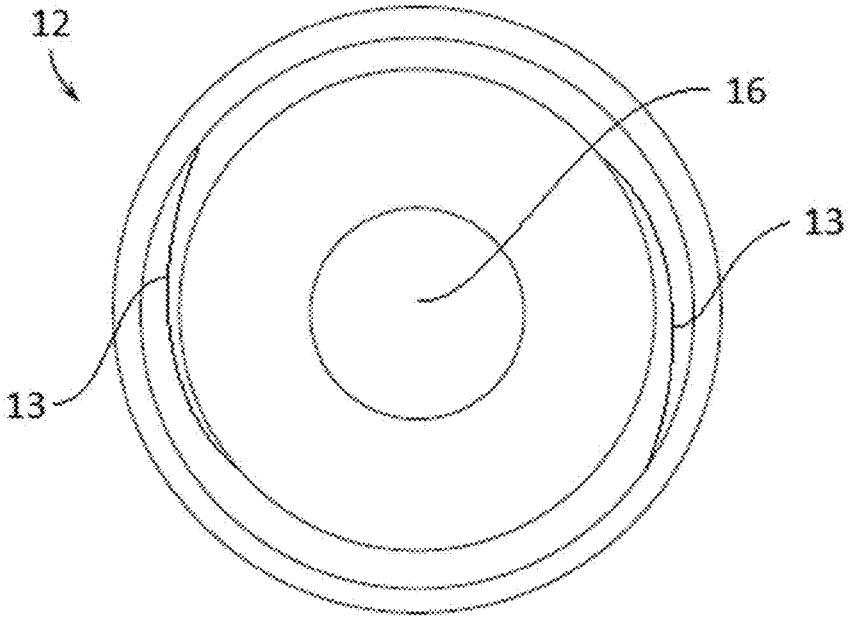
FIG. 4A depicts a top plan view of an example of a plate member of a protective apparatus for rotary control knobs according to various embodiments described herein.
Figure 4B:
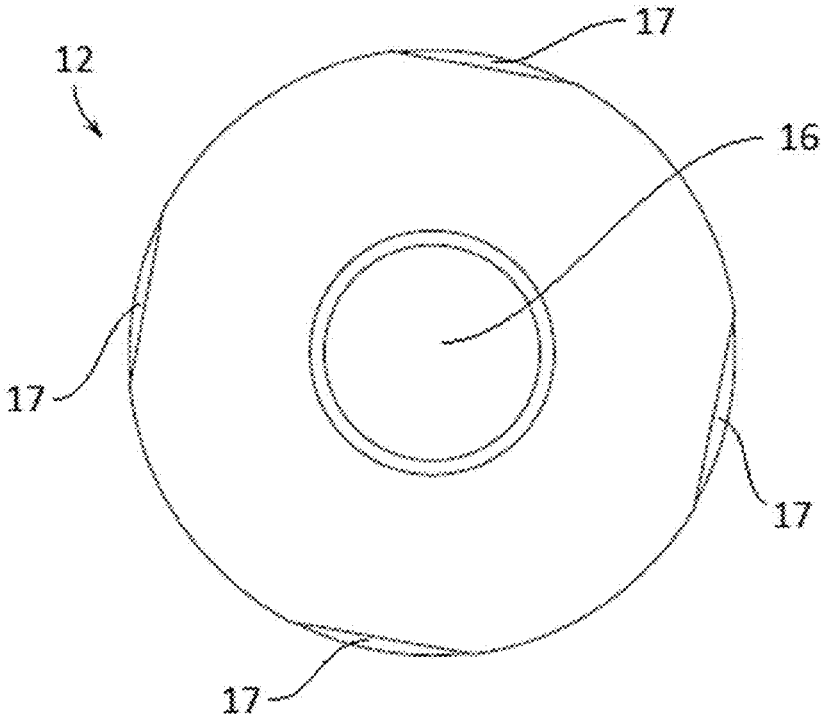
FIG. 4B depicts a bottom plan view of an example of a plate member of a protective apparatus for rotary control knobs according to various embodiments described herein.

FIG. 4A depicts a top plan view and FIG. 4B depicts a bottom plan view of an example of a plate member 12. As best shown in FIG. 4B, the plate member 12 comprises a control shaft aperture 16 configured to receive the control shaft 215 (FIG. 5) of a rotary control unit. The coupling device 13 is disposed on the upper surface of the plate member 12, while one or more facets 17 may be located on the perimeter edges of plate member 12. The one more facets 17 may be configured as indentions or grooves positioned around the perimeter of the plate member 12 and may be provided to facilitate improved gripping and handling, such as during installation and removal, of the plate member 12.

Figure 5:
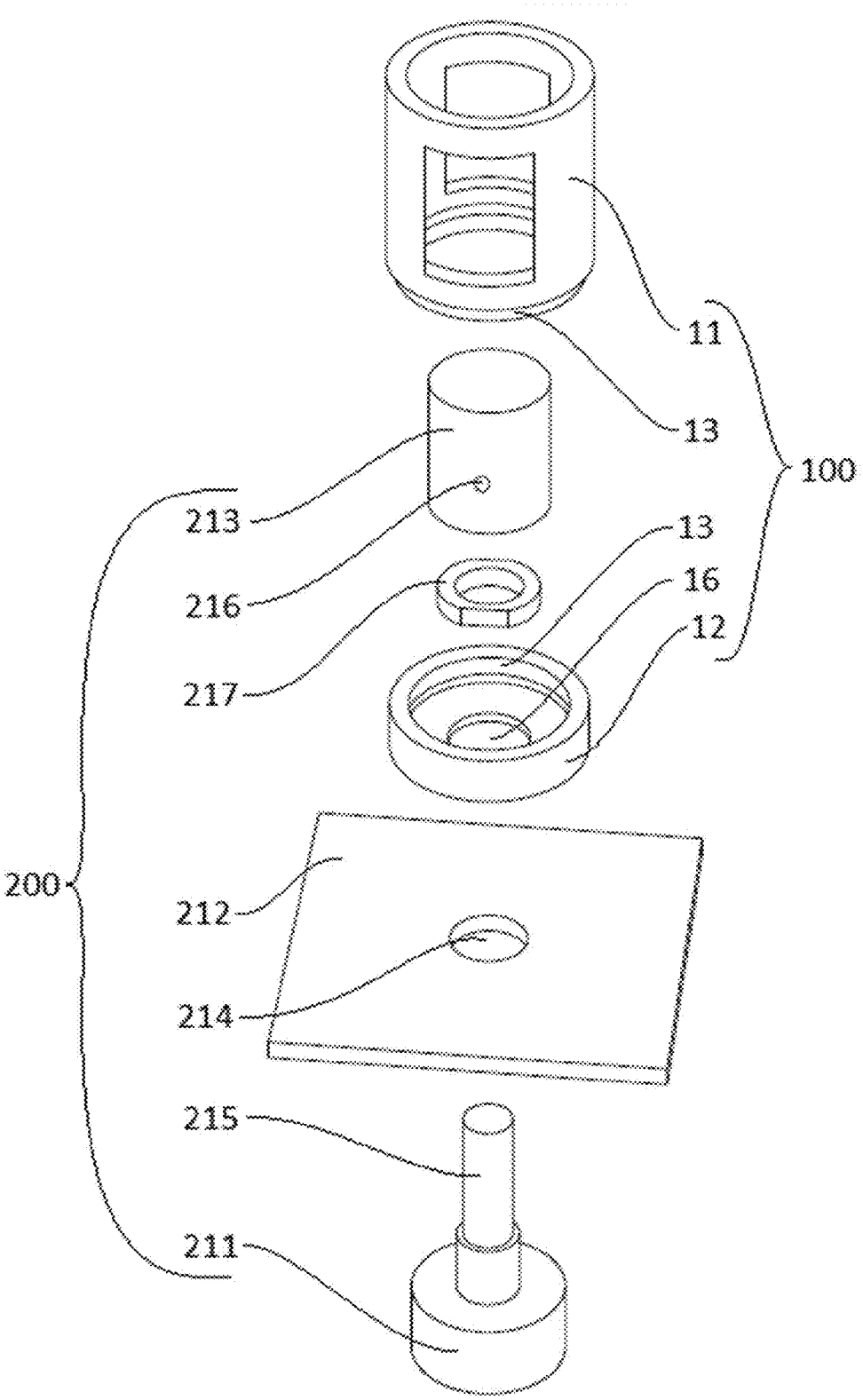
FIG. 5 illustrates an exploded perspective view of the arrangement of members of an example of a protective apparatus for rotary control knobs over a rotary control knob assembly according to various embodiments described herein.

As perhaps best shown by FIG. 5, an exploded perspective view of the arrangement of members of an apparatus 100 over a rotary control knob assembly 200 according to various embodiments described herein is shown. In this example, the rotary control unit 211 is positioned below the case surface 212 of an electric device, such as an effects pedal or stomp box, and shown removed from the case aperture 214. Typically, the rotary control unit 211 is positioned adjacently below the case surface 212 so the control shaft 215 extends through the case aperture 214.

In preferred embodiments, to install the apparatus 100 depicted in FIG. 5, a set screw is removed from the set screw aperture 216 allowing the knob 213 to be removed from the control shaft 215. Next, the control shaft aperture 16 of the plate member 12 is placed over the control shaft 215 and placed in contact with the case surface 212 so that the control shaft aperture 16 and case aperture 214 are aligned allowing the control shaft 215 to be inserted through both case aperture 214 and control shaft aperture 16. A threaded fastener 217 which may preferably already be installed and included with a rotary control unit 211, may be used to secure the plate member 12 to the case surface 212. Although a threaded fastener 217 is shown by this example in FIG. 5, other types of fasteners may be used in some alternative embodiments. In this and in preferred embodiments, the user may adjust the plate member 12 (and optionally the cover member 11) in various orientations on case surface 212 to obtain the desired location for lateral access aperture(s) 15 before securing the plate member 12 with threaded fastener 217 or by other means. The ability to adjust the location of lateral access apertures 15 is valuable in circumstances where an electronic device may have multiple control knobs 213 and protective apparatuses 100 and allows optimal positioning of each aperture 15. Next, the knob 213 may then be replaced and secured on the control shaft 215 by attaching the set screw through the set screw aperture 216. Finally, the cover member 11 is attached to the plate member 12 by engagement of their respective coupling devices 13. Removal of the apparatus 100 may be accomplished by performing the above mentioned steps in a reverse order.

In preferred embodiments, the plate member 12 and cover member 11 may be adjustable, for example by rotation, allowing the optimal configuration of the access apertures 15 for a variety of different device setups and knob 213 configurations. In one example, the plate member 12 may be configured to rotate about a central vertical access on top of case surface 212 allowing for the desired orientation of the access apertures 15. In yet further examples, the cover member 11 may be configured to rotate about a center axis while connected to plate member 12, for example, by turning cover member 11 within a threaded coupling device 13, access apertures 15 may be positioned at optimal orientations.

In other embodiments, the plate member 12 and cover member 11 may be permanently engaged to each other so that the final step of attaching the cover member 11 to the plate member 12 of the above mentioned installation procedure may be omitted.

Figure 6:
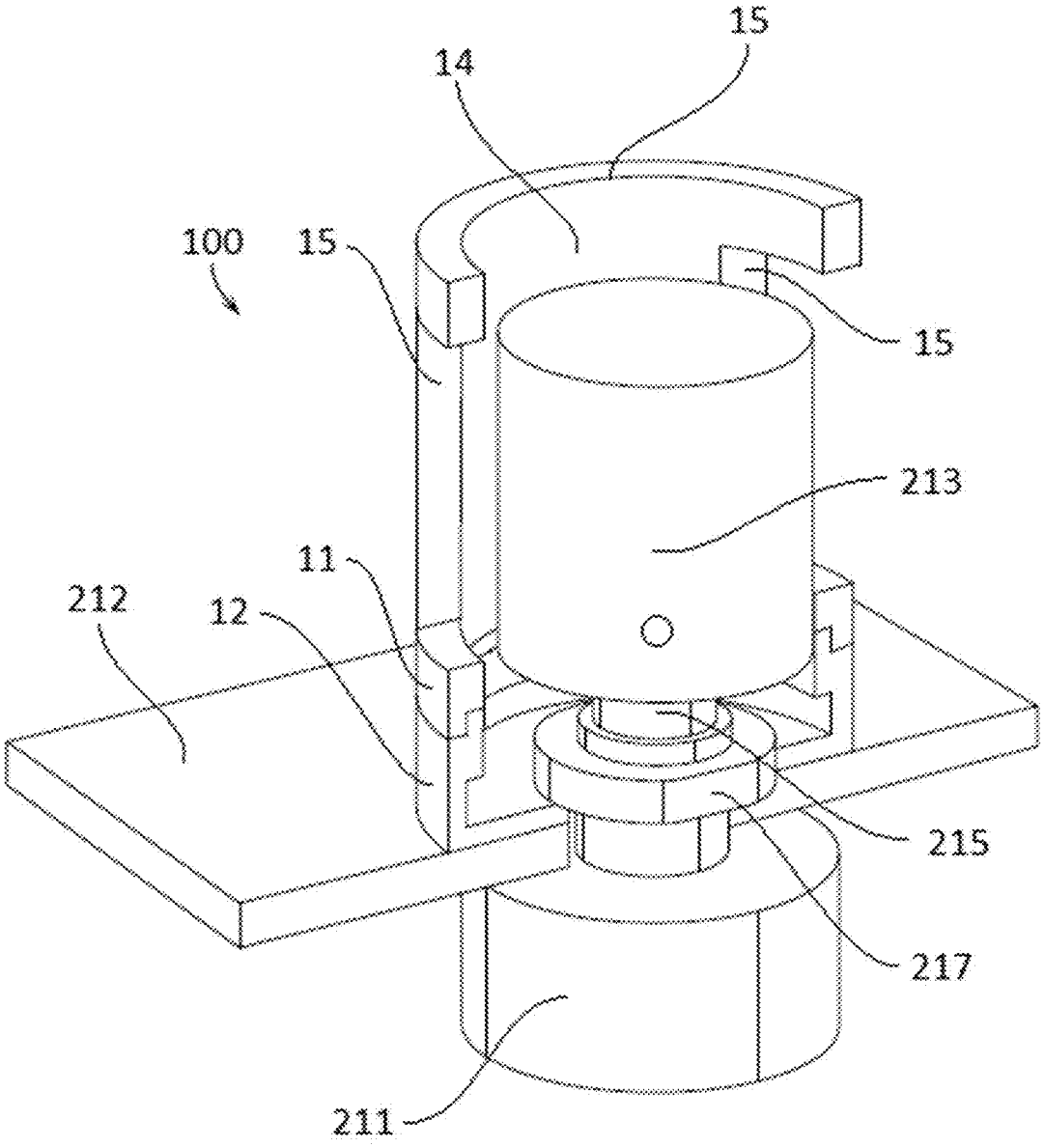
FIG. 6 shows a cut away perspective view of an example of a protective apparatus for rotary control knobs configured to encase a control knob according to various embodiments described herein.

FIG. 6 shows a partial cut away perspective view of an example of an apparatus 100 configured to encase a control knob 213 according to various embodiments of the present invention. In this embodiment, the threaded fastener 217 is securing the plate member 12, and also the engaged cover member 11, to the case surface 212. The knob 213 is secured to the control shaft 215 of the rotary control unit 211 so that rotational motion of the knob 213 is transcribed into rotational movement of the rotary control unit 211. Two lateral access apertures 15 and a terminally positioned vertical access aperture 15 allow a user to manipulate the knob 213 located in the knob cavity 14 of the apparatus 100.

Figure 7:
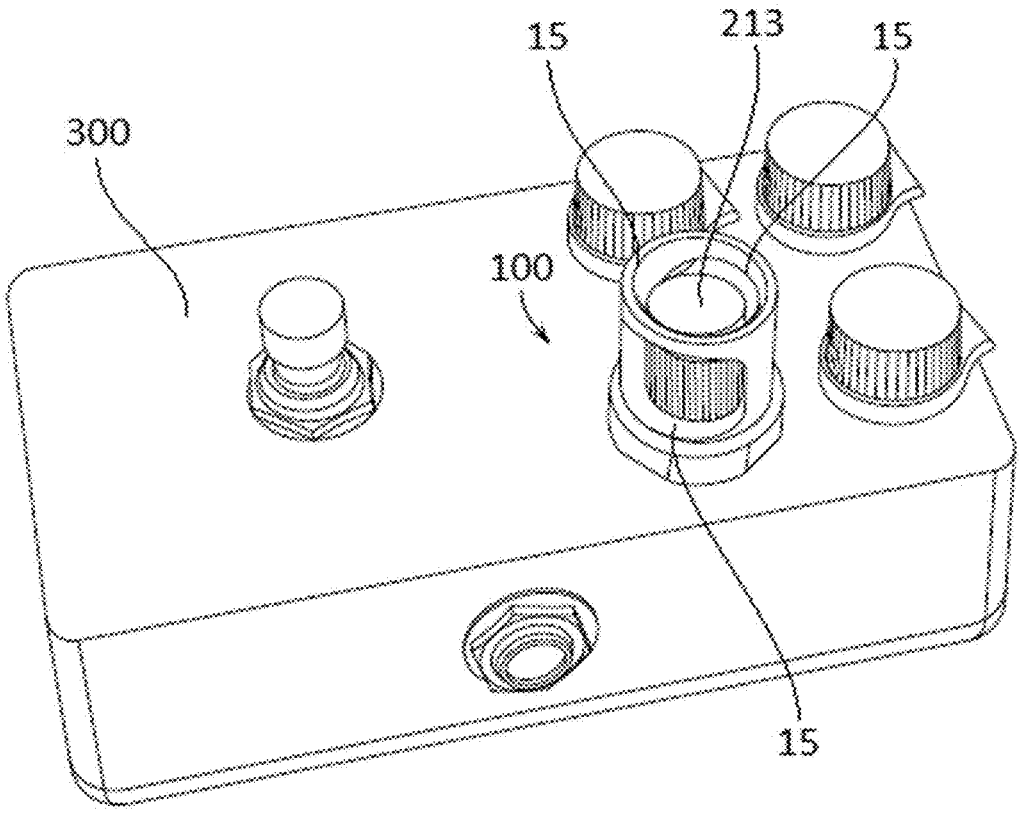
FIG. 7 depicts a side perspective view of an example of a protective apparatus for rotary control knobs encasing a knob of an electronic device according to various embodiments described herein.

Turning now to FIG. 7, a side perspective view of an apparatus 100 encasing a knob 213 of an electronic device 300 according to various embodiments of the present invention is depicted. In this embodiment, one knob 213 of an electronic device 300, such as an effects pedal, is encased or surrounded by the apparatus 100 to prevent accidental and unintentional manipulation of the knob 213 so that the encased knob 213 may only be manipulated through two lateral access apertures 15 and a terminal vertical access aperture 15.

In this and preferred embodiments, the apparatus 100 is configured to surround or encase a knob 213 of an electronic device 300 such as an effects pedal. In other embodiments, the apparatus 100 may be configured to encase a rotary control unit, knob, button, switch, or other control actuator on any other electronic device 300. In further embodiments, the apparatus 100 may be configured to encase two or more control knobs or actuators simultaneously.

Figure 8:
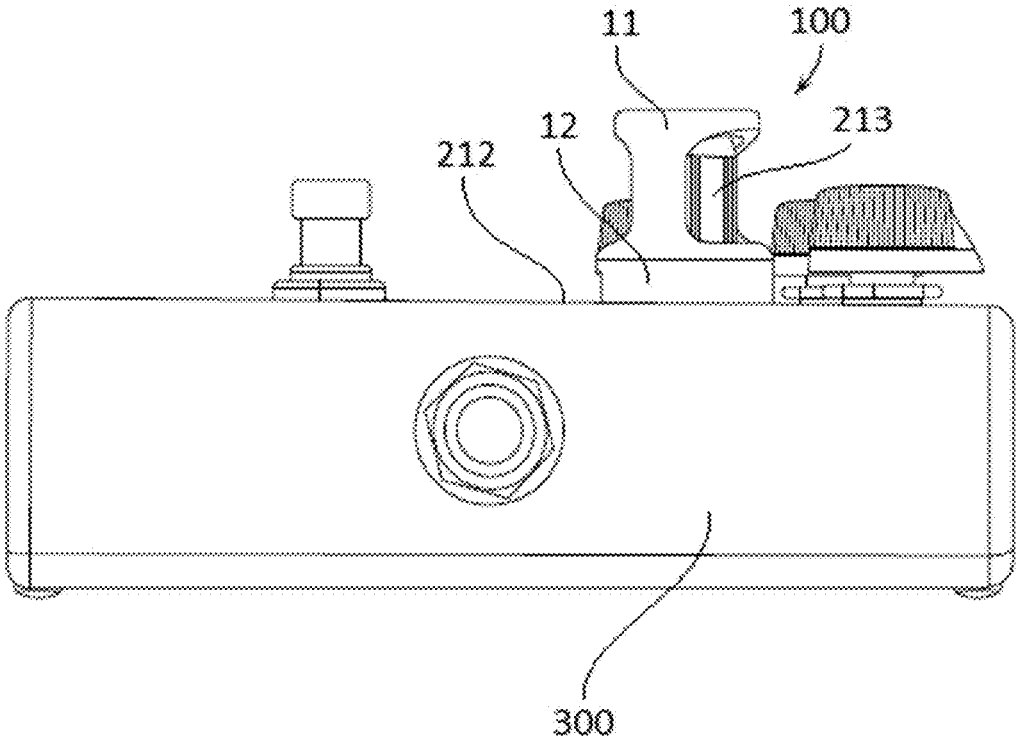
FIG. 8 illustrates a side profile view of an example of a protective apparatus for rotary control knobs encasing a knob of an electronic device according to various embodiments described herein.

FIG. 8 illustrates a side profile view of an example of an apparatus 100 encasing a knob 213 of an electronic device 300 according to various embodiments of the present invention. The cover member 11 is surrounding a knob 213 and engaged to a plate member 12, while the plate member 12 is contacting the case surface 212 of the electronic device 300.

Various positions and configurations of the access apertures 15 on the cover member 11 are contemplated, with four exemplary embodiments shown in FIG. 9. The embodiment depicted in FIG. 9A depicts an apparatus 100 configured with one lateral and one terminal vertical access aperture 15. In other embodiments, the apparatus 100 may comprise two lateral access apertures 15 and no terminal vertical access apertures as shown in FIG. 9B wherein the top of the cover member 11 is substantially covered. In the embodiment depicted in FIG. 9C, the cover member 11 does not comprise any access apertures 15 so that the cover member 11 must be disengaged and removed from the plate member 12 in order to manipulate an encased knob 213 (FIGS. 5, 6, 7, and 8). In further embodiments, as illustrated in FIG. 9D, the cover member 11 of the apparatus 100 may comprise one terminally vertically positioned access aperture 15 and no lateral access apertures 15. In still further embodiments, one or more access apertures 15 may be positioned anywhere on the cover member 11 and/or the plate member 12. In even further embodiments, an apparatus 100 comprising fewer access apertures 15 may be considered to encase a knob 213 (FIGS. 5, 6, 7, and 8), while an apparatus 100 comprising a greater number of access apertures 15 may be considered to surround a knob 213 (FIGS. 5, 6, 7, and 8).

Turning now to FIGS. 10-16, an alternative example of a protective apparatus for rotary control knobs 100 according to various embodiments is illustrated. In this example, the apparatus 100 comprises a cover 31 and a plate 32 which may be integrally formed or coupled together. The cover 31 may preferably be fashioned in a cylindrical-like shape, comprising a knob cavity 14 configured to be larger than and to encase a desired rotary control knob, but other shapes can be envisioned, thereby allowing the knob cavity 14 to receive a control knob 213 (FIGS. 5-7, and 16). A knob cavity 14 may be formed by the cover 31 and plate 32, with the knob cavity 14 internal to the cover 31 and adapted to provide space for a rotary control knob 213 disposed therein to rotate.

Also depicted in this embodiment are three access apertures 15, disposed on the cover 31, which are configured to allow access to the knob cavity 14 enabling a user to manipulate a control knob positioned in the knob cavity 14. In some embodiments, the cover 31 may comprise two lateral access apertures 15 located opposite one another on the side of the cover 31. In further embodiments, the cover 31 may comprise one vertical access aperture 15 located on the top of the cover 31.

The cover 31 functions as a protective guard to limit unintentional manipulation of an encased control knob 213 caused by accidentally bumping or impacting the knob. In some embodiments, setting marks can be machined on, or affixed to the cover 31 to indicate to the user the degree of rotation of a knob 213.

The plate 32 may comprise a control shaft aperture 16 which may be shaped to receive a control shaft 215 (FIGS. 5, 6, and 16) of an electronic device 300 (FIGS. 7 and 8) to which a knob 213 may be affixed. In some embodiments, a control shaft aperture 16 may comprise a generally circular shape, thereby allowing it to receive a generally cylindrically shaped control shaft 215. In other embodiments, similar to an access aperture 15, a shaft aperture 16 may be configured in a plurality of sizes and shapes including square shaped, rectangular shaped, cuboid shaped, hexagonal prism shaped, triangular prism shaped, or any other geometric or non-geometric shape, including combinations of shapes. It is not intended herein to mention all the possible shape alternatives that an access aperture 15 and/or a shaft aperture 16 may be configured in. It is understood that the terms and proposed shapes used herein are merely descriptive, rather than limiting, and that various changes, such as to size and shape, may be made without departing from the spirit or scope of the invention.

Figure 16:
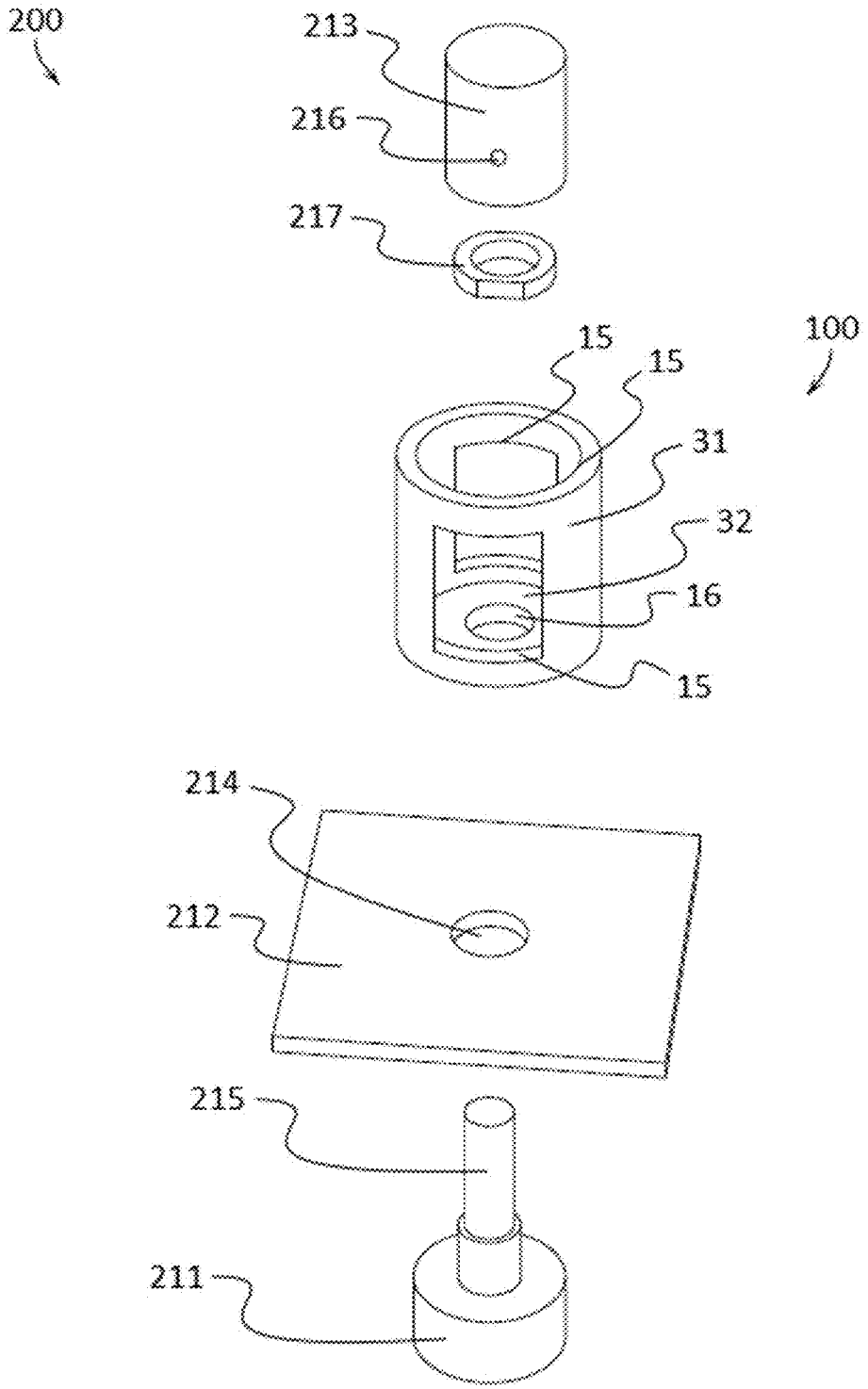
FIG. 16 depicts an exploded perspective view of the arrangement of an alternative example of a protective apparatus for rotary control knobs over a rotary control knob assembly according to various embodiments described herein.

FIG. 16 depicts an exploded perspective view of the arrangement of an alternative example of a protective apparatus for rotary control knobs 100 over a rotary control knob assembly 200 according to various embodiments described herein. In preferred embodiments, to install the apparatus 100 a set screw may be removed from the set screw aperture 216 allowing the knob 213 to be removed from the control shaft 215. A threaded fastener 217 which is typically positioned under the knob 213 may also be removed from the control shaft 215. Next, the control shaft aperture 16 of the plate 32 may be placed over the control shaft 215 and placed in contact with the case surface 212 so that the control shaft aperture 16 and case aperture 214 are generally aligned allowing the control shaft 215 to be inserted through both case aperture 214 and control shaft aperture 16. The threaded fastener 217 may be re-installed on the control shaft 215 over the control shaft aperture 16 and may be used to secure the plate 32, and therefore the cover 31 of the apparatus 100 to the case surface 212. Although a threaded fastener 217 is shown by this example in FIG. 16, other types of fasteners may be used in some alternative embodiments.

In this and in preferred embodiments, the user may adjust the plate 32 (and optionally the cover 31) in various orientations on case surface 212 to obtain the desired location for lateral access aperture(s) 15 before securing the plate 32 with threaded fastener 217 or by other means. The ability to adjust the location of lateral access apertures 15 is valuable in circumstances where an electronic device may have multiple control knobs 213 and protective apparatuses 100 and allows optimal positioning of each aperture 15. In some embodiments, apparatus 100 may be configured to rotate about a central axis 500 (FIG. 10) to change the orientation of the lateral access apertures 15 by rotating the apparatus 100 about a control shaft 215 which is inserted through the control shaft aperture 16.

Figure 9A:
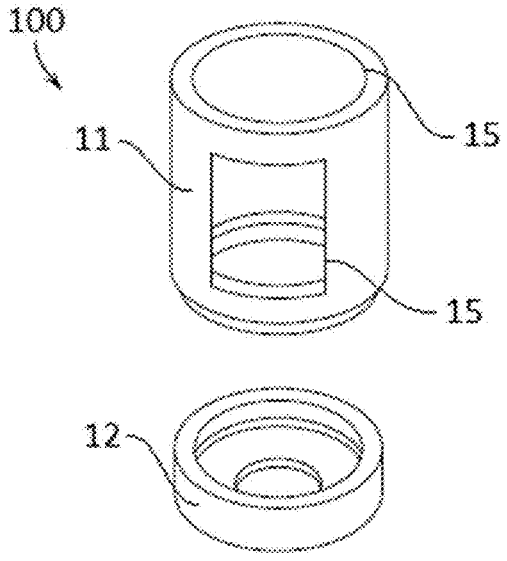
FIG. 9A shows a perspective view of an example of an alternative protective apparatus for rotary control knobs configured to encase a control knob assembly according to various embodiments described herein.
Figure 9B:
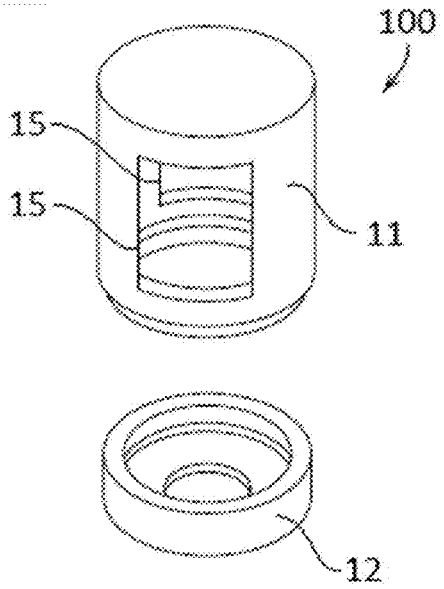
FIG. 9B depicts a perspective view of an example of an alternative protective apparatus for rotary control knobs configured to encase a control knob assembly according to various embodiments described herein.
Figure 9C:
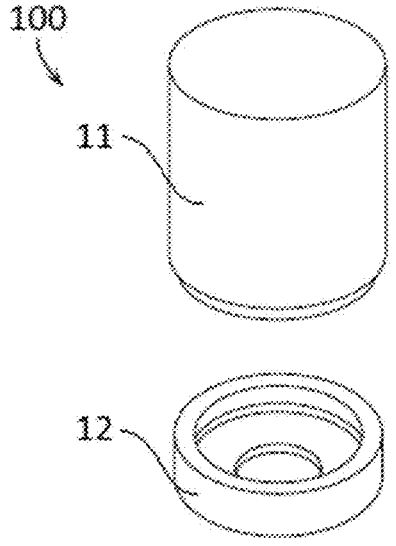
FIG. 9C illustrates a perspective view of an example of an alternative protective apparatus for rotary control knobs configured to encase a control knob assembly according to various embodiments described herein.
Figure 9D:
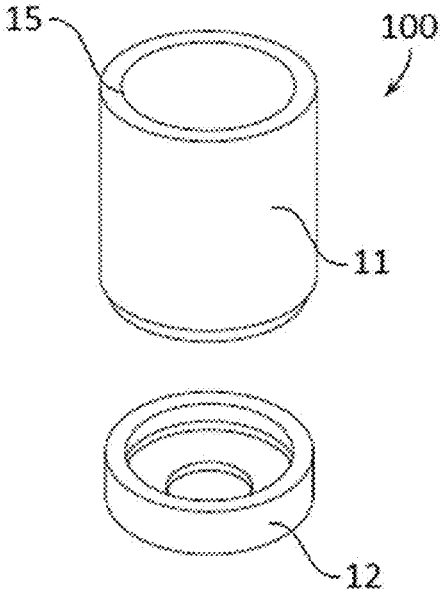
FIG. 9D shows a perspective view of an example of an alternative protective apparatus for rotary control knobs configured to encase a control knob assembly according to various embodiments described herein.
Figure 10:
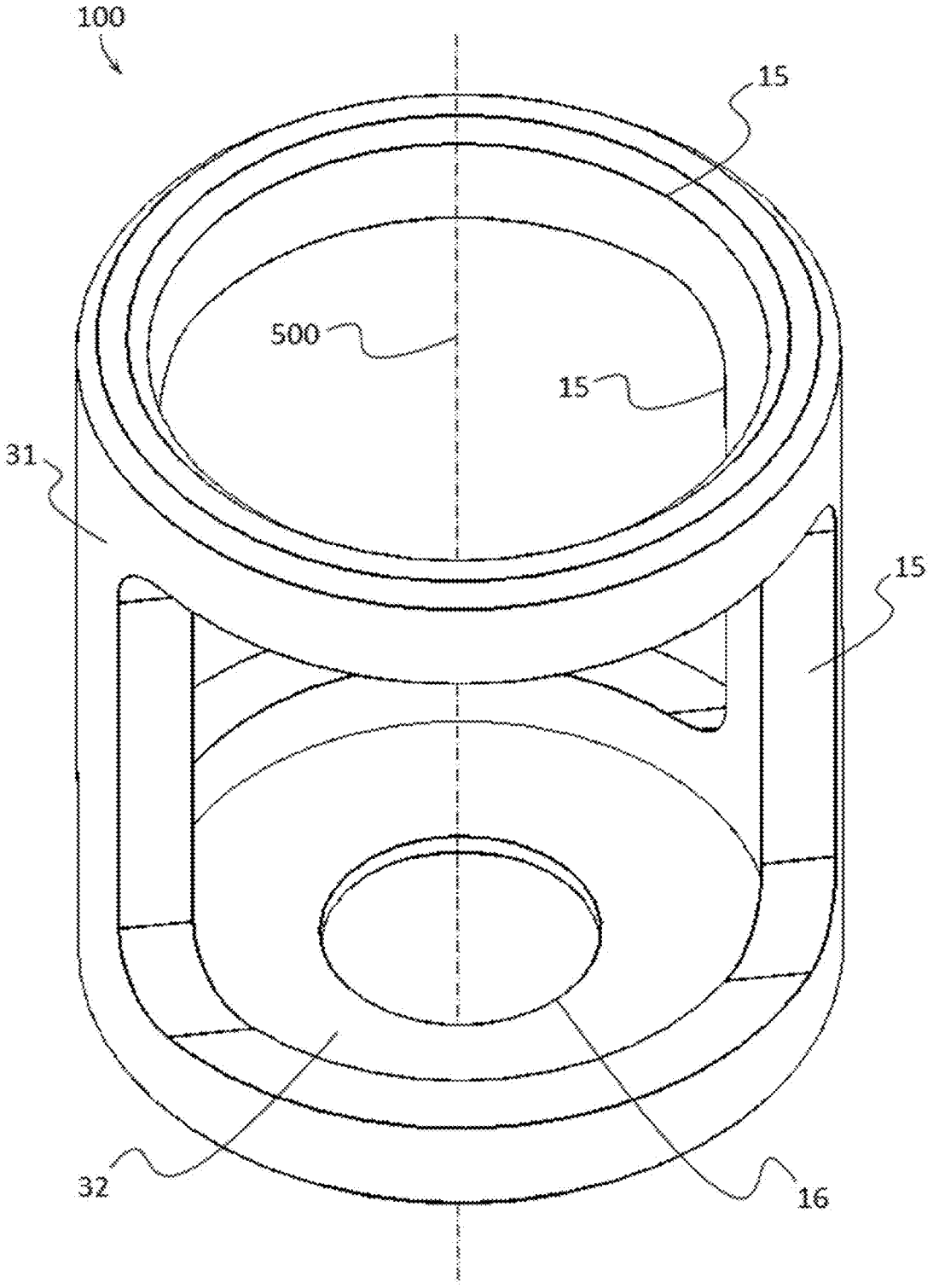
FIG. 10 depicts a top perspective view of an alternative example of a protective apparatus for rotary control knobs encasing a knob of an electronic device according to various embodiments described herein.
Figure 11:
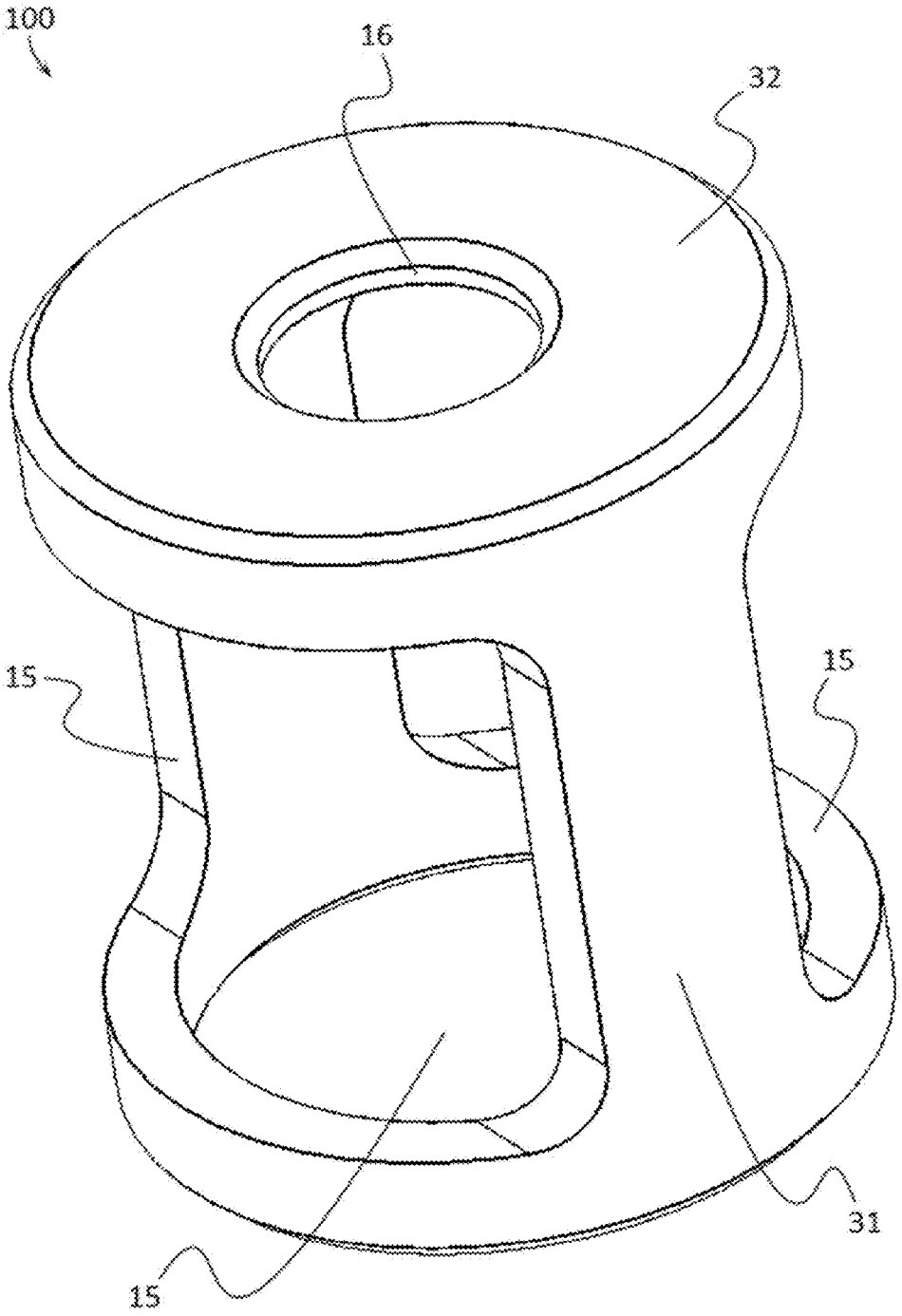
FIG. 11 illustrates a bottom perspective view of an alternative example of a protective apparatus for rotary control knobs encasing a knob of an electronic device according to various embodiments described herein.
Figure 12:
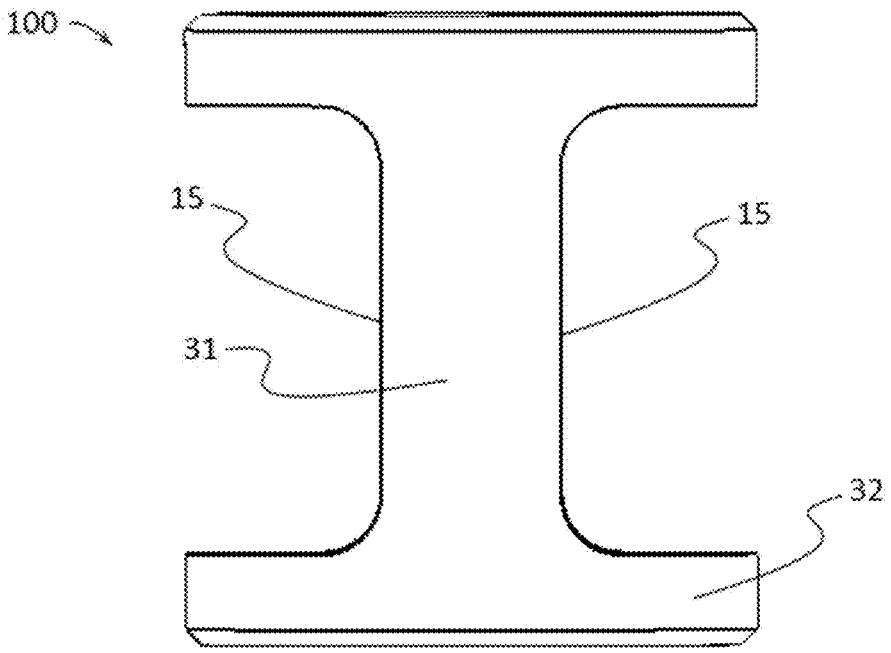
FIG. 12 shows a first side elevation view of an alternative example of a protective apparatus for rotary control knobs according to various embodiments described herein.
Figure 13:
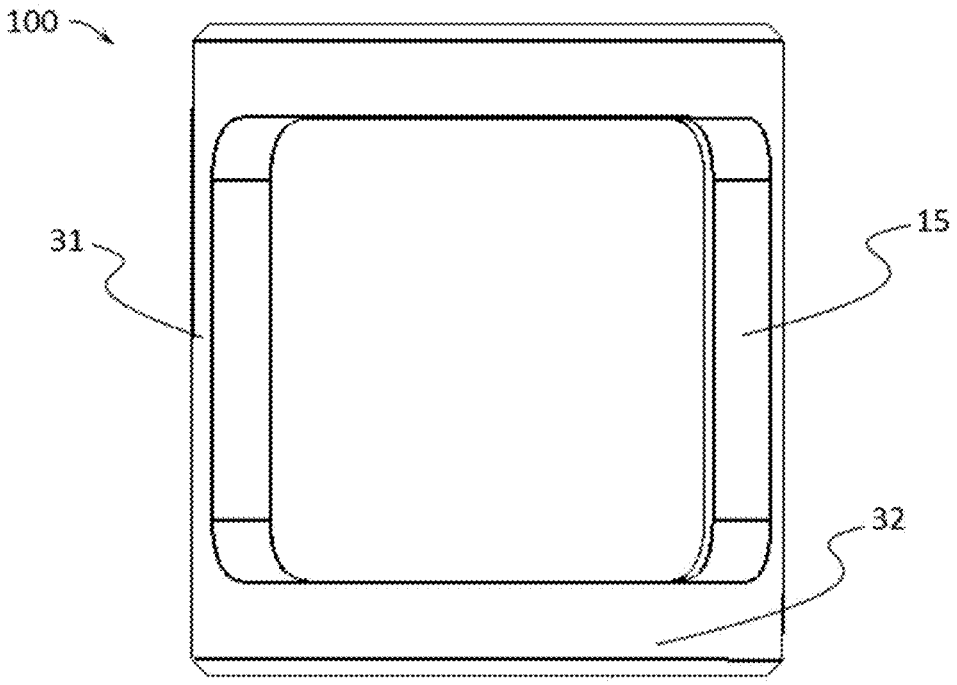
FIG. 13 depicts a second side elevation view of an alternative example of a protective apparatus for rotary control knobs according to various embodiments described herein.
Figure 14:
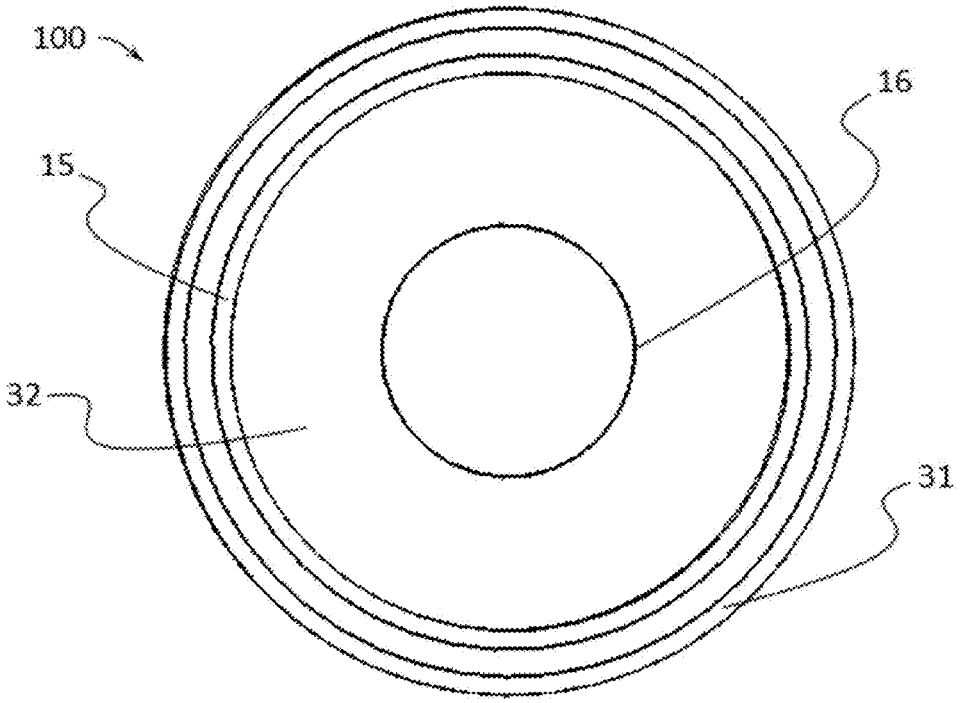
FIG. 14 illustrates a top plan view of an alternative example of a protective apparatus for rotary control knobs according to various embodiments described herein.
Figure 15:
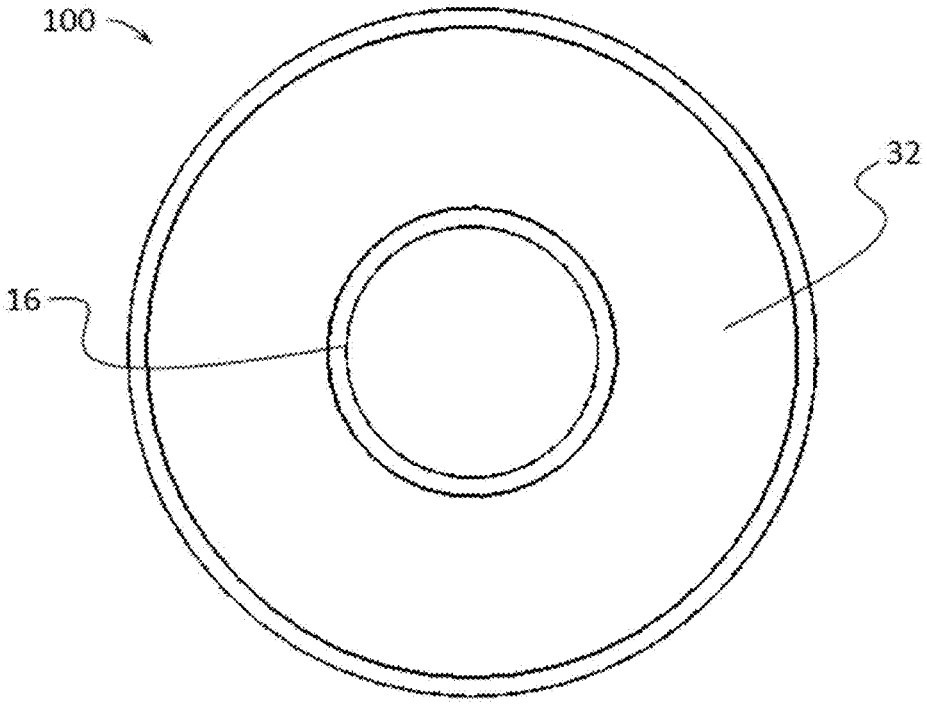
FIG. 15 shows a bottom plan view of an alternative example of a protective apparatuses for rotary control knobs according to various embodiments described herein.

In preferred embodiments, the members and components that comprise the apparatus 100 may be made from durable materials such as hard plastics, metal alloys, wood, hard rubbers, carbon fiber, or any other suitable materials including combinations of materials. Additionally, one or more members may be made from durable and slightly flexible materials such as soft plastics, silicone, soft rubbers, or any other suitable materials including combinations of materials. In some embodiments, such as shown in FIG. 9C, the members may be made from transparent or semi-transparent materials to facilitate visual inspection of the encased knob settings.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A protective apparatus for rotary control knobs, the apparatus comprising:

a cover adapted fit over a rotary control knob, the cover being rotatably mounted to a case surface of an electric device;

a knob cavity internal to the cover and adapted to provide space for the rotary control knob to rotate about, the knob cavity surrounding all sides and a top of the rotary control knob creating a space between the top of the rotary control knob and a top end of the cover;

a first and a second lateral access aperture located on sides of the cover and adapted to provide limited access to the rotary control knob;

a vertical access aperture located on the top end of the cover above the rotary control knob and above the knob cavity, the vertical access aperture allowing for a visual line of sight through the cover to the rotary control knob; and the top end of the cover protruding upwardly away from the case surface at a first distance above the case surface and the rotary control knob protruding upwardly away from the case surface at a second distance above the case surface, the first distance being greater than the second distance so that the cover completely surrounds and encases the rotary control knob from both the sides and from above.

2. The protective apparatus according to claim 1, further comprising a plate.

3. The protective apparatus according to claim 2, wherein the plate and cover are integrally formed together.

4. The protective apparatus according to claim 2, wherein the plate contains a control shaft aperture adapted to receive the control shaft of a rotary control assembly.

5. The protective apparatus according to claim 4, wherein the apparatus is configured to rotate about a central axis to change the orientation of the lateral access apertures.

6. The protective apparatus according to claim 1, wherein the electronic device is a musical effects pedal.

7. The protective apparatus according to claim 1, wherein the electronic device is a stomp box.

8. The protective apparatus according to claim 1, wherein the cover is rotably coupled to the case surface allowing the cover to rotate about a central axis to change the orientation of the lateral access apertures relative to the electronic device and rotary control knob while both the electronic device and the rotary control knob remain in a fixed position.

9. The protective apparatus according to claim 1, wherein both the cover and the rotary control knob are both rotabably coupled to the electronic device and configured to rotate in different directions relative to each other.

* * * * *